US005126710A

United States Patent [19]

Schueller et al.

[11] Patent Number: 5,126,710

[45] Date of Patent: Jun. 30, 1992

[54] ELECTROMAGNETIC RELAY POLARIZED BY A PERMANENT MAGNET

[75] Inventors: Pierre Schueller, Grenoble; Pierre Laffont, Sassenage; Bruno Querlioz, Vif, all of France

[73] Assignee: Merlin Gerin, France

[21] Appl. No.: 630,209

[22] Filed: Dec. 19, 1990

[30] Foreign Application Priority Data

Jan. 5, 1990 [FR] France ..... 9000142

[51] Int. Cl.[5] ..... H01H 51/22

[52] U.S. Cl. ..... 335/85; 335/78; 335/81

[58] Field of Search ..... 335/78–85, 335/124, 128

[56] References Cited

U.S. PATENT DOCUMENTS 3,984,795 10/1976 Gaskill ..... 335/170

FOREIGN PATENT DOCUMENTS 0107167 5/1984 European Pat. Off. .
0187055 11/1985 European Pat. Off. ..... 335/80
0305321 3/1989 European Pat. Off. .
2412160 7/1979 France .
2573570 5/1986 France .

*Primary Examiner*—Lincoln Donovan
*Attorney, Agent, or Firm*—Parkhurst, Wendel & Rossi

[57] ABSTRACT

A high-sensitivity electromagnetic relay comprises a magnetic circuit polarized by a permanent magnet, a flux distributor, an operating coil, and a moving core cooperating with the flux distributor by means of an air-gap. A return spring passes completely through the core being inserted between the flux distributor and the external end of a guide tube, which is shaped as a bottleneck having a widened part housing the core, and a narrow part capable of sliding in an aperture.

8 Claims, 1 Drawing Sheet

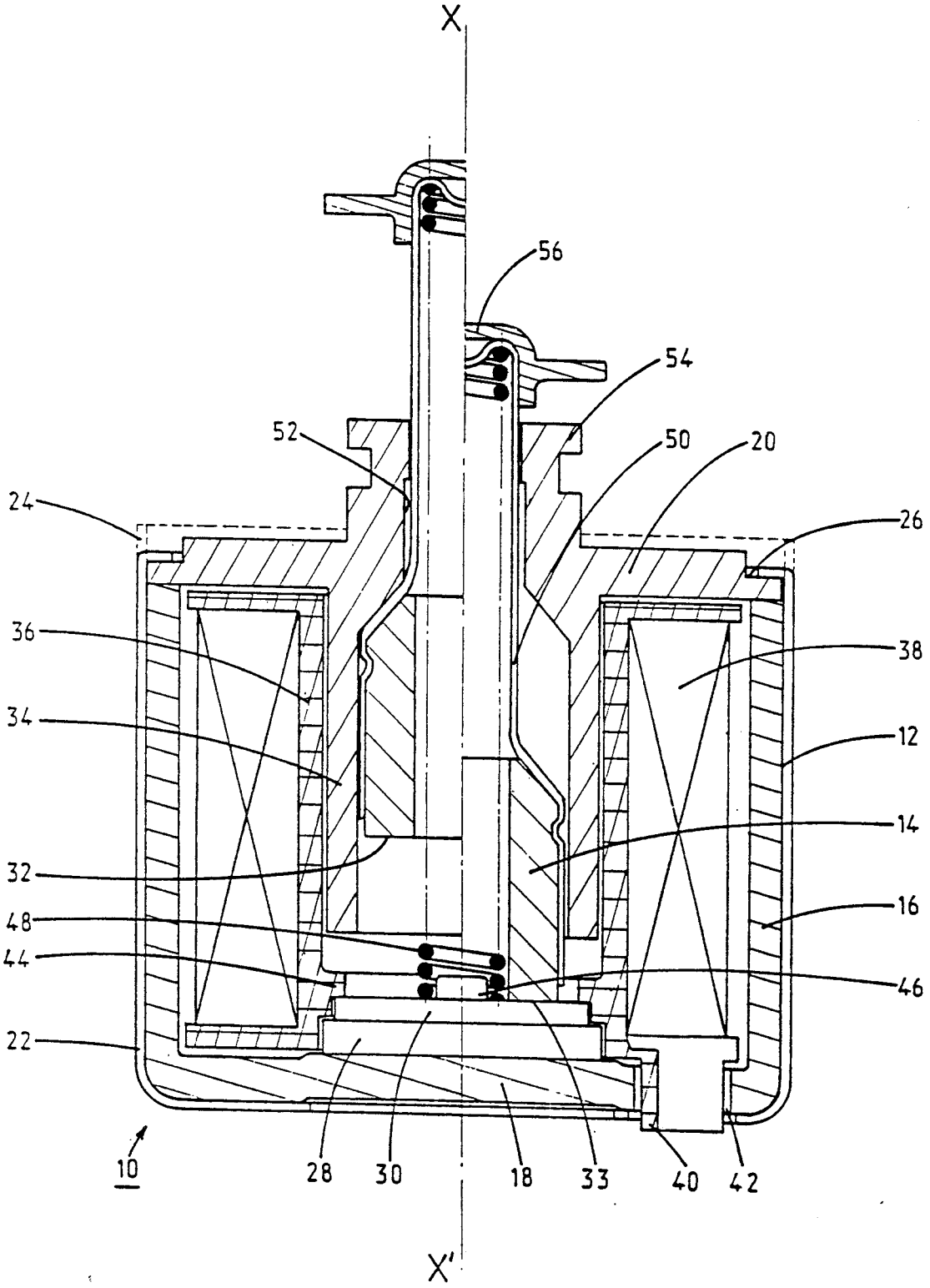
X
56
54
52
50
20
24
26
36
38
34
12
14
32
16
48
44
46
22
10
28
30
18
33
40
42
X'

ELECTROMAGNETIC RELAY POLARIZED BY A PERMANENT MAGNET

BACKGROUND OF THE INVENTION

The invention relates to a polarized electromagnetic relay with magnetic latching, comprising a fixed magnetic circuit formed by assembly of a first and a second yoke bounding an internal space enclosing a permanent magnet bearing against the bottom part of the first yoke, and designed to create a first magnetic polarization flux; a flux distributor in contact with the opposite face of the a moving core mounted with axial sliding in the direction of tripping position, and having a polar surface cooperating with the flux distributor by means of an axial air-gap, operating magnetic flux opposing the first polarization flux, a return spring for urging the core to the tripping position when and an external trip push-button securedly united to the moving core.

A relay of this kind is described in the document EP-A 187,055. The flux distributor and permanent magnet are annular so as to enable the return spring which bears on the bottom part of the magnetic circuit to pass through. The other end of the spring is housed in a blind orifice of the core. Housing the spring inside a blind orifice of the magnetic circuit increases the size of the relay lengthwise, and the weight of the moving core. The hole in the flux distributor does not ensure correct insulation of the magnetic latching zone with respect to the permanent magnet. The tubular yoke is achieved by a costly turning operation.

The object of the invention consists in increasing the speed and reliability of a high-sensitivity polarized relay, and in reducing its size lengthwise.

SUMMARY OF THE INVENTION

The relay according to the invention is characterized in that the return spring passes right through the core, being inserted between the flux distributor and the external end of a guide tube, which passes axially through an aperture of the second yoke, being securedly united to the core.

The hole passing completely through which core has an core, and the axial length less than half the overall length of the relay enable the weight of the core to be reduced, thereby increasing the tripping speed of the relay.

In a preferred embodiment, permanent magnet and the flux distributor have appreciably identical external diameters, corresponding to the internal permanent magnet of reduced size and cost to be used.

In another preferred embodiment, guide tube is shaped as a bottle-neck having a widened part housing the core, and a narrow part capable of sliding in the aperture.

In still another preferred embodiment, sheath is provided with a connecting base passing through an orifice in the bottom part of the first yoke for the connecting conductors of the coil to pass through.

Also the first yoke and/or the guide tube of the core are achieved by a deep drawing operation.

BRIEF DESCRIPTION OF THE DRAWING

Other advantages and features will become more clearly apparent from the following description of an illustrative embodiment of the invention, given as a non-restrictive example only and represented in cross-section in the accompanying drawing, the left and right half-views of which show the relay respectively in the tripping position, and in the attraction position of the moving core.

DESCRIPTION OF THE PREFERRED EMBODIMENT

In the Figure, a high-sensitivity electromagnetic relay 10 acts as tripping device for a mechanism of an electrical circuit breaker. The relay 10 comprises a fixed magnetic circuit 12, and a moving core 14 slidably mounted in the direction of the longitudinal axis XX' between an attraction position (right-hand half-view) and a tripping position (left-hand half-view).

The magnetic circuit 12 is made of ferromagnetic material, and comprises a first tubular yoke 16 closed at one of its ends by a bottom part 18 extending perpendicularly to the longitudinal axis XX'. The yoke 16 and bottom part 18 constitute a single part obtained by a deep drawing operation. Opposite the bottom part 18, a second yoke 20 covers the open end of the first yoke 16 to close the magnetic circuit 12. Assembly of the two yokes 16, 20 is performed either by direct crimping or by means of an additional cover 22 covering the first yoke 16, and having a front edge 24 capable of being folded on an annular shoulder 26 of the second yoke 20. The cover 22 is made of magnetic or non-magnetic material, and has a thickness less than that of the first yoke 16.

The magnetic circuit 12 is polarized by an axial magnetization magnet 28 bearing on the bottom part 18 inside the first yoke 16. A flux distributor 30 is superposed on the magnet 28, and cooperates directly with the polar surface 32 of the moving core 14 via an axial air-gap 33. The magnet 28 and flux distributor 30 have cylindrical shapes of appreciably the same diameter.

The second yoke 20 is equipped with a tubular internal sleeve 34 made of ferromagnetic material extending partially in an annular space arranged coaxially between the moving core 14 and an insulating sheath 36 acting as support for a cylindrical operating coil 38. The opposite front faces of the cylindrical sheath 36 are arranged between the bottom 18 and the second yoke 20 and one of them comprises a connecting base 40 passing through an orifice 42 of the bottom part 18 for the connecting conductors of the coil 38 to pass through.

The coil 38 is mounted coaxially on the insulating sheath 36, whose internal side wall comprises an annular protruberance 44 disposed axially between the free end of the sleeve 34 and the base 40. The role of the protruberance 44 consists in wedging the flux distributor 30 against the magnet 28. The centre part of the flux distributor 30 is provided with a centering pin 46, on which there is wound a return spring 48 for urging the moving core 14 to the tripping position when the coil 38 is excited.

The core 14 is fixed inside the widened part of a guide tube 50 in the shape of a bottle-neck, the end of the narrow part of which passes axially through a circular aperture 52 arranged in a bearing 54 of the second yoke 20. The spring 48 passes completely through the core 14 and bears on the flux distributor 30 and the end of the guide tube 50.

The guide tube 50 is advantageously made of a non-magnetic or insulating material having a low friction coefficient and is achieved by a deep drawing operation. Fixing of the core 14 in the tube 50 is achieved by sticking or by crimping. The end of the tube 50 is covered by a cap 56 arranged as an external trip pushbutton.

The axial length of the moving core 14 is less than half the overall length of the relay 10 corresponding to the distance between the external faces of the bottom part 18 and of the second yoke 20. The weight of the moving assembly is thus reduced to the minimum thereby enabling the speed of the relay 10 to be increased.

Operation of the polarized relay 10 is similar to that described in the document EP 187,055. Given that the flux distributor 30 and the permanent magnet 28 have appreciably identical external diameters, corresponding, clearance apart, to the internal diameter of the sheath 36, the shunt flux $\phi s$ which loops back directly between the permanent magnet 28 and the first yoke 16 is very low. This results in a minimum size of the permanent magnet 28 formed notably by a single washer made of a material having a rare earth base and a very high coercivity. Operation of the relay 10 is achieved by means of two preponderant opposing fluxes, comprising the first magnetic flux $\phi u$ polarizing the permanent magnet 28, and the second magnetic flux $\phi c$ operating the coil 38.

On the right-hand half-view, the coil 38 is not excited and the core 14 is held in the attraction position against the flux distributor 30 by the action of the first polarization flux $\phi u$.

The second opposing operating flux $\phi c$ only appears when the coil 38 is excited by the tripping signal. As soon as the return force of the spring 48 becomes greater than the magnetic attraction force, the core 14 and guide tube 50 are propelled to the tripping position (left-hand half-view).

It can be noted the spring 48 simply bears on the upper face of the flux distributor 30. Such an arrangement enables the permanent magnet 28 to be insulated from the magnetic latching zone with the core 14.

What is claimed is:

1. A polarized electromagnetic relay comprising:

a first yoke; and a second yoke which cooperates with said first yoke to thereby define an internal space, said internal space comprising:

a) a permanent magnet in contact with a bottom part of said first yoke for creating a polarization magnetic flux;

b) a flux distributor in contact with said permanent magnet opposite said bottom part of said first yoke;

c) a generally cylindrical slidable moving core movable in its axial direction between an attraction position and a tripping position, said slidable core comprising a polar surface cooperable with said flux distributor by means of an axial air gap;

d) a cylindrical coil coaxially mounted on an insulating sheath, said cylindrical coil providing means for generating an operating magnetic flux opposing said polarization magnetic flux;

e) a return spring for providing a biasing means for moving said moving core to said tripping position when said cylindrical coil is excited; and f) an external trip push button attached to said moving core by a guide tube, said moving core being securedly attached to and substantially inside said guide tube, said guide tube at least partially enclosing said return spring therein, wherein said cylindrical coil and said guide tube are hollow and said return spring passes completely through said moving core.

2. The relay of claim 1, wherein said permanent magnet and said flux distributor have substantially identical external diameters, said diameters corresponding to the internal diameter of said insulating sheath.

3. The relay of claim 1, wherein the internal wall of said insulating sheath comprises an annular protuberance designed to hold said flux distributor against said permanent magnet.

4. The relay of claim 1, wherein said second yoke comprises a tubular internal sleeve arranged radially between said insulating sheath and said guide tube, said tubular internal sleeve extends axially toward said annular protuberance.

5. The relay of claim 1, wherein said guide tube is bottle-neck shaped including a wide part housing said moving core and a narrow part capable of sliding within an aperture defined by said second yoke.

6. The relay of claim 1, wherein said insulating sheath includes a connecting base passing through an orifice in said bottom part of said first yoke for passing therethrough conductors connected to said cylindrical coil.

7. The relay of claim 1, wherein the axial length of said moving core is less than half the overall length of said relay, and an external diameter of said moving core is greater than the diameter of an aperture defined by said second yoke.

8. The relay of claim 1, wherein a metal cover covers said first yoke, said metal cover including an annular rim folded onto an annular shoulder of said second yoke to thereby secure said second yoke to said first yoke.

* * * * *